US007201334B2

(12) United States Patent
Sasaki et al.

(10) Patent No.: US 7,201,334 B2
(45) Date of Patent: Apr. 10, 2007

(54) FUEL INJECTION NOZZLE HAVING MULTIPLE INJECTION HOLES

(75) Inventors: Satoru Sasaki, Kariya (JP); Tokuji Kuronita, Obu (JP); Kanehito Nakamura, Ichinomiya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/504,661

(22) Filed: Aug. 16, 2006

(65) Prior Publication Data

US 2007/0039587 A1 Feb. 22, 2007

(30) Foreign Application Priority Data

Aug. 19, 2005 (JP) ..... 2005-239117

(51) Int. Cl.
*B05B 1/32* (2006.01)

(52) U.S. Cl. ..... 239/585.5; 123/305

(58) Field of Classification Search ..... 123/305; 239/585.5

See application file for complete search history.

(56) References Cited

U.S. PATENT DOCUMENTS 1,494,020 A * 5/1924 Riehm ..... 123/305
4,202,500 A * 5/1980 Keiczek ..... 239/533.3
4,546,739 A * 10/1985 Nakajima et al. ..... 123/299
4,699,323 A * 10/1987 Rush et al. ..... 239/585.4
5,540,200 A 7/1996 Naitoh et al.
5,556,034 A * 9/1996 Sakakida et al. ..... 239/585.5
6,513,487 B1 * 2/2003 Jorach et al. ..... 123/305
6,564,772 B1 * 5/2003 Shyu et al. ..... 123/305
6,758,407 B1 * 7/2004 Lambert et al. ..... 123/305

FOREIGN PATENT DOCUMENTS

JP 7-167016 7/1995
JP 9-88766 3/1997
JP 2001-165017 6/2001

* cited by examiner

*Primary Examiner*—Erick Solis
(74) *Attorney, Agent, or Firm*—Nixon & Vanderhye P.C.

(57) ABSTRACT

A fuel injection nozzle includes: an injection outlet having a plurality of injection holes. Each injection hole has an injection hole diameter defined as D, an outlet port and a center axis. The center axes of the injection holes cross at a cross point with a cross angle. A cross point distance between each outlet port of the injection holes and the cross point is defined as X. The cross angle of the center axes of the injection holes is defined as θ. The cross point distance X is in a range between 10 D and 100 D, and the cross angle θ is in a range between 1° and 10°.

8 Claims, 10 Drawing Sheets

FUEL INJECTION NOZZLE HAVING MULTIPLE INJECTION HOLES

CROSS REFERENCE TO RELATED APPLICATION

This application is based on Japanese Patent Application No. 2005-239117 filed on Aug. 19, 2005, the disclosure of which is incorporated herein by reference.

FIELD OF THE INVENTION

The present invention relates to a fuel injection nozzle having multiple injection holes.

BACKGROUND OF THE INVENTION

A diesel engine has a self-ignition system. Specifically, a fuel is introduced, i.e., supplied into a combustion chamber of the engine, and then, air with the fuel in the combustion chamber is compressed so that a temperature in the combustion chamber increases. Thus, the air with the fuel having high temperature is self-ignited. It is a main issue for the diesel engine to reduce generation of toxic substance in exhaust gas. Specifically, in order to perform combustion appropriately for reducing the toxic substance, atomization and spray penetration of the fuel, which is injected from a fuel injection nozzle, are much important for the diesel engine. Further, in view of reducing smoke in the exhaust gas discharged from the diesel engine, the atomization and spray penetration of the fuel are important.

To promote the atomization of the fuel and to increase the spray penetration of the fuel, a fuel injection nozzle having multiple injection holes is provided. This nozzle includes multiple injection holes having a small diameter, which are arranged close together so that the injection holes provide one fuel spray, i.e., one fuel jet. Specifically, each injection hole injects the fuel so that a fuel jet is generated. Then, the fuel jets injected from the injection holes are integrated so that one fuel jet is formed. This nozzle is disclosed in, for example, JP-A-H07-167016 and JP-A-H09-088766.

Since multiple injection holes in the above nozzle jets, i.e., sprays, the fuel, a diameter of each injection hole can be smaller. Thus, the fuel is atomized, i.e., a fuel jet sprayed from each injection hole is atomized. Further, by interacting fuel jets injected from the injection holes, the spray penetration of the fuel jet is obtained.

The above multiple injection hole type fuel injection nozzle is, for example, a parallel center axis type nozzle, a diffusion type nozzle or a collision type nozzle. The parallel center axis type nozzle has multiple injection holes, center axes of which are in parallel together. The diffusion type nozzle has multiple injection holes, center axes of which are opened, i.e., broaden. The collision type nozzle has multiple injection holes, center axes of which are closed, i.e., narrowed.

In the parallel center axis type nozzle, interaction among the fuel jets becomes small, so that fuel spray travel (spray tip length), i.e., a reaching distance of the fuel jet becomes short. Thus, the air in the combustion chamber of the engine is not sufficiently mixed with the fuel jet. Accordingly, the smoke in the exhaust gas generates, as shown in FIG. 9B.

Here, another parallel center axis type nozzle is provided. In this nozzle, a distance between adjacent two injection holes (i.e., injection hole distance L) is short. The interaction of the fuel jets becomes large, so that the spray penetration of the fuel jets is obtained. However, in this nozzle, fuel concentration near the center of the fuel jet axis is increased, so that a part of the fuel jet having a high fuel concentration burns. Accordingly, the smoke may generate from combustion of the part of the fuel jet, as shown in FIG. 9A.

In the diffusion type nozzle, since the interaction between the fuel jets sprayed from the injection holes becomes small, the fuel spray tip length of the fuel jet becomes short. Accordingly, the smoke may generate from combustion of the part of the fuel jet, as shown in FIG. 9B.

In the collision type nozzle, the fuel jets from the injection holes strike, i.e., intersect or cross each other. Therefore, the spray penetration along with the fuel injection axis becomes small. Thus, the fuel spray tip length of the fuel jet becomes short. Further, the interaction of the fuel jets becomes strong, so that the fuel concentration near the center of the fuel jet axis is increased. Accordingly, the smoke may generate from combustion of the part of the fuel jet, as shown in FIG. 9B.

Here, in FIGS. 8 to 9B, VIIIA represents a first region (i.e., an initial injection region) of the fuel jet just after the fuel is injected from the nozzle. VIIIB represents a second region (i.e., an atomization and evaporation region) of the fuel jet after the fuel jet expands in the initial injection region VIIIA. Then, VIIIC represents a third region (i.e., a preliminary mixture region) of the fuel jet after the fuel jet expands in the atomization and evaporation region VIIIB. Then, VIIID represents a fourth region VIIID (i.e., a combustion region) after the fuel jet expands in the preliminary mixture region VIIIC.

In the prior art, the spray penetration and the atomization of the fuel have a trade-off relationship. Accordingly, it is difficult to valance the spray penetration and the atomization. In view of this problem, a new fuel injection nozzle in a fuel injection valve of direct injection engine having a self-ignition system is requested. In the new fuel injection nozzle, the spray penetration of the fuel jet jetted from the new injection nozzle is appropriately controlled so that the air disposed in a combustion chamber from the outlet of an injection hole of the new injection nozzle to an inner wall of the chamber burns with the fuel jet sufficiently. Further, combustion of the air with the fuel jet substantially ends before the fuel jet reaches the inner wall of the chamber.

Specifically, it is requested for a new fuel injection nozzle to control atomization and spray penetration of a fuel jet appropriately so that the combustion of the air with the fuel jet is completed sufficiently.

SUMMARY OF THE INVENTION

In view of the above-described problem, it is an object of the present disclosure to provide a fuel injection nozzle.

According to a first aspect of the present disclosure, a fuel injection nozzle includes: an injection outlet having a plurality of injection holes. Each injection hole has an injection hole diameter defined as D. Each injection hole has an outlet port and a center axis. The center axes of the injection holes cross at a cross point with a cross angle. A cross point distance between each outlet port of the injection holes and the cross point is defined as X. The cross angle of the center axes of the injection holes is defined as $\theta$. The cross point distance X is in a range between 10 D and 100 D, and the cross angle $\theta$ is in a range between 1° and 10°.

In the above nozzle, sufficient atomization of the fuel and sufficient spray penetration of the fuel jet are obtained. Thus, the spray tip length of the atomized fuel jet can be controlled so that the spray tip length is determined in accordance with the inner wall distance between the injection outlet and the inner wall of the combustion chamber. Thus, the injection outlet is capable of injecting the fuel toward the inner wall of the combustion chamber in such a manner that air in the combustion chamber disposed between the injection outlet and the inner wall of the combustion chamber is completely utilized for combustion by controlling spray penetration of a fuel jet injected from the injection outlet, and that the combustion of the fuel injected from the injection outlet is substantially completed before the fuel jet reaches the inner wall of the combustion chamber.

According to a second aspect of the present disclosure, a fuel injection nozzle includes an injection outlet having a plurality of injection holes. Each injection hole has an injection hole diameter defined as D. Each injection hole has an outlet port and a center axis. The center axes of the injection holes cross at a cross point with a cross angle. A cross point distance between each outlet port of the injection holes and the cross point is defined as X. The cross angle of the center axes of the injection holes is defined as θ. The cross point distance X is in a range between 10 D and 100 D. The cross angle θ is in a range between 1° and 10°. The injection hole diameter D is in a range between 0.05 mm and 0.1 mm. The injection outlet is capable of injecting a fuel having a fuel pressure equal to or larger than 100 MPa. The injection outlet is capable of injecting the fuel into a combustion chamber along with an injection direction. The combustion chamber has an inner wall. An inner wall distance between each outlet port of the injection holes and the inner wall of the combustion chamber in the injection direction of the injection outlet is defined as S. The inner wall distance S is in a range between 350 D and 450 D. The injection outlet is capable of injecting the fuel toward the inner wall of the combustion chamber in such a manner that air in the combustion chamber disposed between the injection outlet and the inner wall of the combustion chamber is completely utilized for combustion by controlling spray penetration of a fuel jet injected from the injection outlet, and that the combustion of the fuel injected from the injection outlet is substantially completed before the fuel jet reaches the inner wall of the combustion chamber.

In the above nozzle, sufficient atomization of the fuel and sufficient spray penetration of the fuel jet are obtained. Thus, the spray tip length of the atomized fuel jet can be controlled so that the spray tip length is determined in accordance with the inner wall distance between the injection outlet and the inner wall of the combustion chamber.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

A fuel injection nozzle according to an example embodiment is shown in FIGS. 1 to 11. Firstly, outline of a construction of the nozzle is explained.

Figure 11:
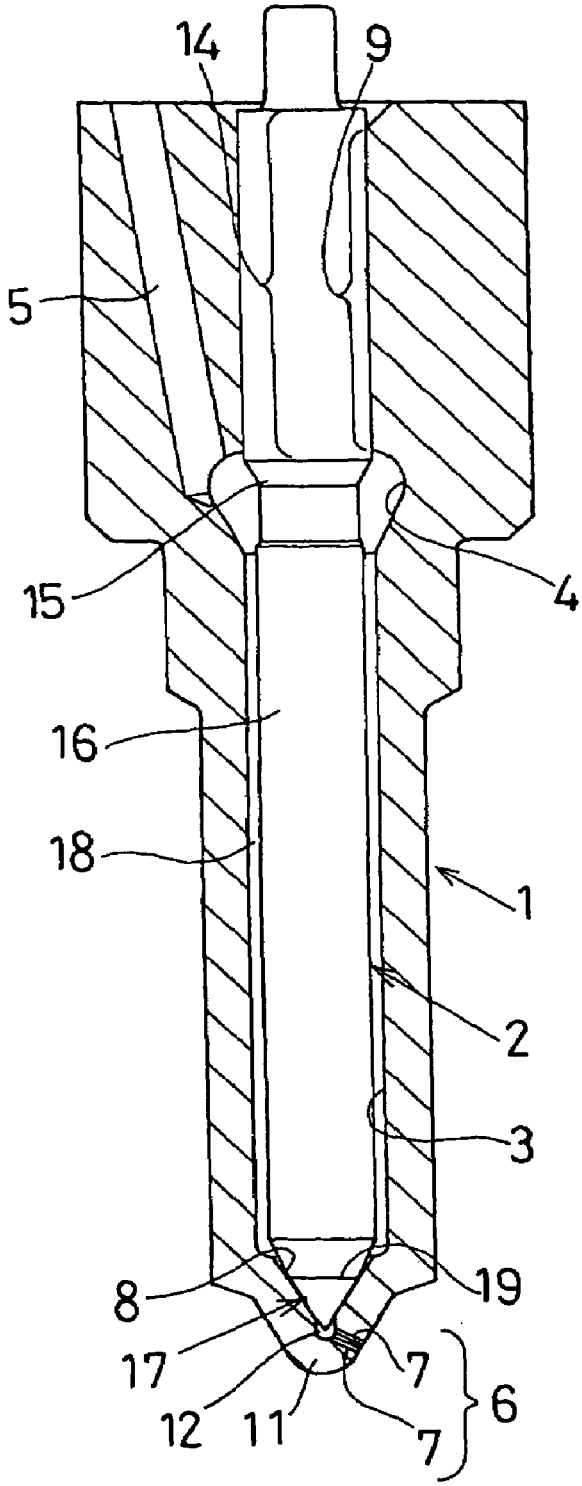
FIG. 11 is a cross sectional view showing the fuel injection nozzle according to the first example embodiment.

As shown in FIG. 11, the nozzle functions for jetting, i.e., spraying, a high pressure fuel into a cylinder of a diesel engine. The nozzle includes a nozzle body 1 and a needle 2. The nozzle is assembled in a nozzle holder (not shown), and the nozzle holder with the nozzle is mounted in the engine.

Figure 1A:
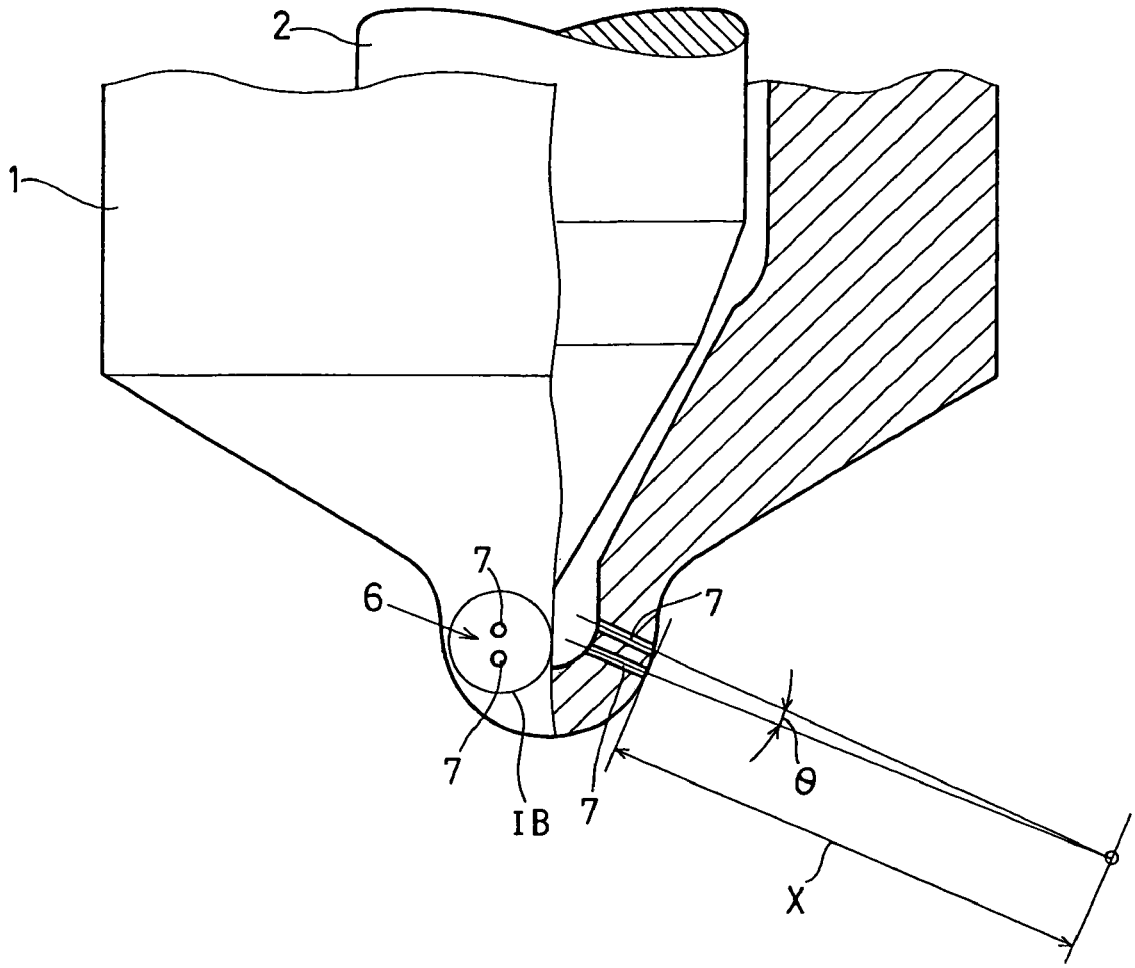
FIG. 1A is a schematic view showing a part of a fuel injection nozzle according to a first example embodiment.
Figure 1B:
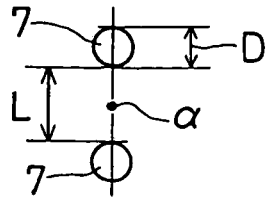
FIG. 1B is a partially enlarged plan view showing a part IB in FIG. 1A.

The nozzle body 1 includes a guide hole 3 for inserting the needle 2 therein, a fuel reservoir 4 disposed in a middle portion of the guide hole 3, a fuel introduction passage 5 connecting to the fuel reservoir 4, and an injection outlet 6 having multiple injection holes 7 for injecting the high pressure fuel into the cylinder of the engine. Multiple injection holes 7 provide the injection outlet 6, as shown in FIGS. 1A and 1B.

The guide hole 3 is formed from a top end of the nozzle body 1 to a bottom end of the nozzle body 1 to have a constant inner diameter. An opening of the guide hole 3 opened from the top end of the nozzle body 1 has a chamfered peripheral edge. A valve seat 8 having a circular cone shape is formed on the bottom end of the guide hole 3. The injection outlet 6 is disposed on a lower side of the valve seat 8. Here, the lower side of the valve seat 8 is a fuel downstream side.

The fuel reservoir 4 is formed such that an inner diameter of the guide hole 3 is expanded all circumferences. The fuel reservoir 4 provides a space having a ring shape, which is disposed on an outer circumference of the needle 2. Here, the needle 2 is inserted into the guide hole 3. A part of the guide hole 3, which is disposed on an upper side from the fuel reservoir 4 provides a slide hole 9.

The fuel introduction passage 5 is a passage for introducing the high pressure fuel from the nozzle holder (not shown) to the fuel reservoir 4. The fuel introduction passage 5 is disposed from the top end of the nozzle body 1 to the fuel reservoir 4.

Figure 7:
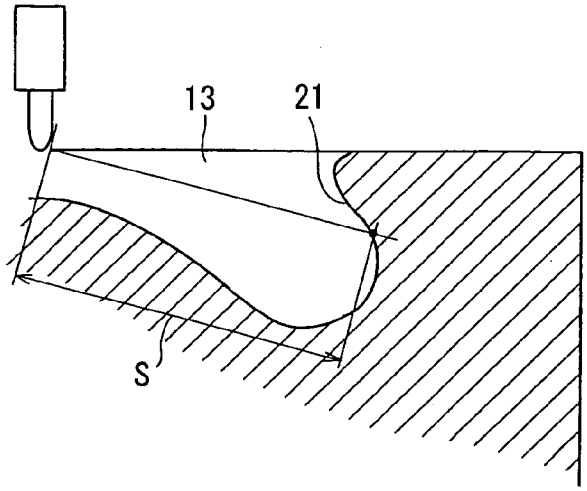
FIG. 7 is a schematic view showing a combustion chamber.

A cone tip 11, i.e., a bottom end of the valve seat 8 or an end of the valve seat 8, is formed on the lower side of the nozzle body 1. A nozzle sac, i.e., a sac volume 12 is formed inside of the cone tip 11. Each injection hole 7 of the injection outlet 6 penetrates the cone tip 11. Specifically, each injection hole 7 obliquely penetrates the cone tip 11 from an inner wall of the cone tip 11, i.e., an inner wall of the sac volume 12, to an outer wall of the cone tip 11. Here, the outer wall of the cone tip 11 is exposed to the inside of a combustion chamber 13, as shown in FIG. 7.

The needle 2 includes a sliding axis portion 14, a pressure receiving surface 15, a shaft 16 and a valve portion 17. The sliding axis portion 14 is slidably supported on an inner surface of the sliding hole 9 of the nozzle body 1 with a predetermined slight clearance therebetween. The pressure receiving surface 15 is formed on a lower portion of the sliding axis portion 14. The shaft 16 extends from the pressure receiving surface 15 to the lower side of the needle 2. The shaft 16 has a small diameter. The valve portion 17 has a circular cone shape. The valve portion 17 contacts and separates form the valve seat 8 so that the injection outlet 6 is opened and closed. The sliding axis portion 14 is slidable, i.e., movable along with an axial direction of the needle 2. Specifically, the sliding axis portion 14 moves between the fuel reservoir 4 and an upper portion of the needle 2 (i.e., a low pressure side of the nozzle). The sliding axis portion 14 is movable in the guide hole 3 with maintaining a seal between the needle 2 and the sliding axis portion 9.

The pressure receiving surface 15 has a tapered shape so that an upper side of the pressure receiving surface 15 is larger than a lower side of the surface 15. The pressure receiving surface 15 is formed on a lower portion of the sliding axis portion 14. The pressure receiving surface 15 faces the fuel reservoir 4.

The shaft 16 has an outer diameter, which is smaller than a diameter of the sliding axis portion 14. The shaft 16 is inserted into the guide hole 3, and disposed under the fuel reservoir 4. The shaft 16 and the guide hole 3 provide a fuel passage 18.

The valve portion 17 disposed on a top end of the needle 2 includes multiple cones having different tapered angles. The valve portion 17 is composed of multiple cones. A sheet line 19 is formed at a boundary between the valve portion 17 and the top end of the needle 2. A spread angle of the top end of the needle 2 disposed above the sheet line 19 is smaller than a spread angle of the valve seat 8. A spread angle of the valve portion 17 disposed below the sheet line 19 is larger than the spread angle of the valve seat 8.

When the valve portion 17 contacts the valve seat 8, the sheet line 19 of the valve portion 17 attaches the valve seat 8 so that the fuel passage 18 and the injection outlet 6 are disconnected. When the valve portion 17 separates from the valve seat 8, the sheet line 19 of the valve portion 17 detaches the valve seat 8 so that the fuel passage 18 and the injection outlet 6 are connected. In this case, the high pressure fuel is sprayed from the injection outlet 6.

An operation of the fuel injection nozzle is explained as follows. Firstly, the high pressure fuel supplied from a fuel pressurizing means such as a common-rail (not shown) is introduced into the fuel introduction passage 5. Then, the fuel is accumulated in the fuel reservoir 4.

An actuator (not shown) such as an electro-magnetic valve or a piezo electric actuator controls the needle 2 so that a downward force (i.e., a closing force) of the needle 2 is reduced. An upward force (i.e., an opening force) of the pressure receiving surface 15, which is caused by the high pressure fuel in the fuel reservoir 4, becomes larger than the closing force of the needle 2. In this case, the needle 2 moves up. Thus, the sheet line 19 of the valve portion 17 separates from the valve seat 8, and the fuel passage 18 and the injection outlet 6 are connected together. Accordingly, the high pressure fuel is jetted from the injection outlet 6 into the chamber 13.

When the actuator stops to control the needle 2 so that the downward force of the needle 2 is increased. The upward force of the pressure receiving surface 15 becomes smaller than the closing force of the needle 2. In this case, the needle 2 moves down. Thus, the sheet line 19 of the valve portion 17 contacts the valve seat 8, and the fuel passage 18 and the injection outlet 6 are disconnected together. Accordingly, the high pressure fuel is not jetted from the injection outlet 6 into the chamber 13, i.e., fuel injection from the injection outlet 6 is stopped.

Figure 2A:
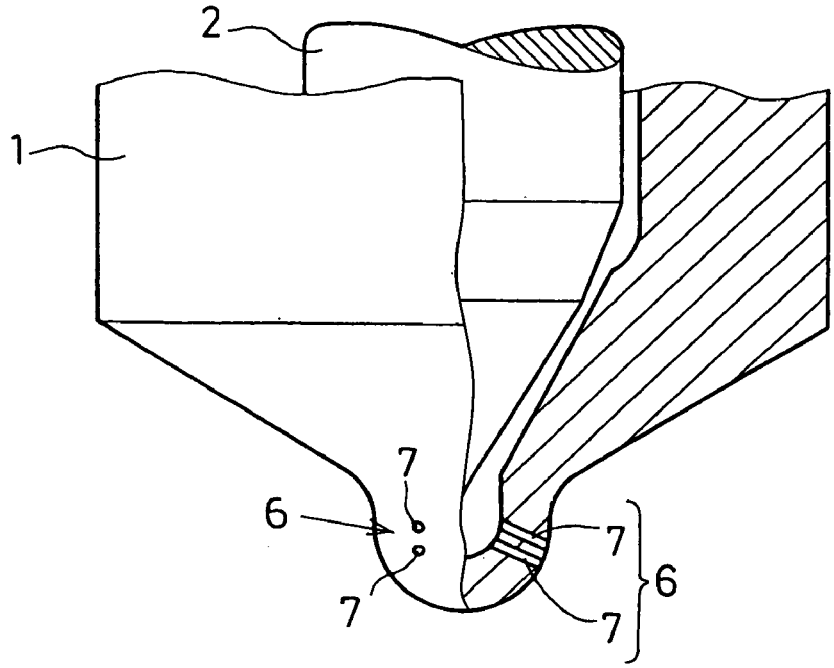
FIG. 2A is a partially enlarged plan view showing an injection outlet having multiple injection holes.
Figure 2B:
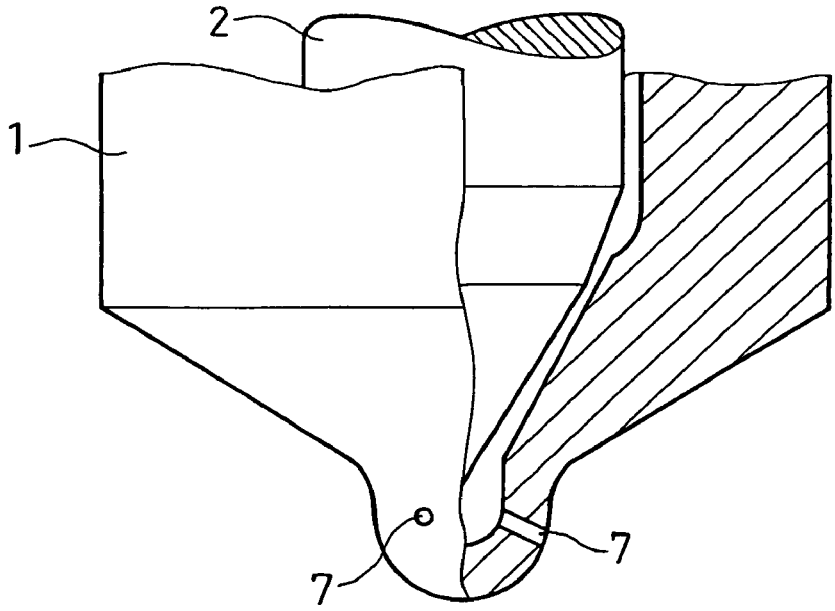
FIG. 2B is a partially enlarged plan view showing an injection outlet having a single injection hole.

The injection outlet 6 in the fuel injection nozzle according to this example embodiment is not a single injection outlet having only one injection hole 7 shown in FIG. 2B, but a multi-injection outlet having multiple injection holes 7 shown in FIG. 2A. In FIG. 2A, the outlet 6 includes two injection holes 7.

Figure 3A:
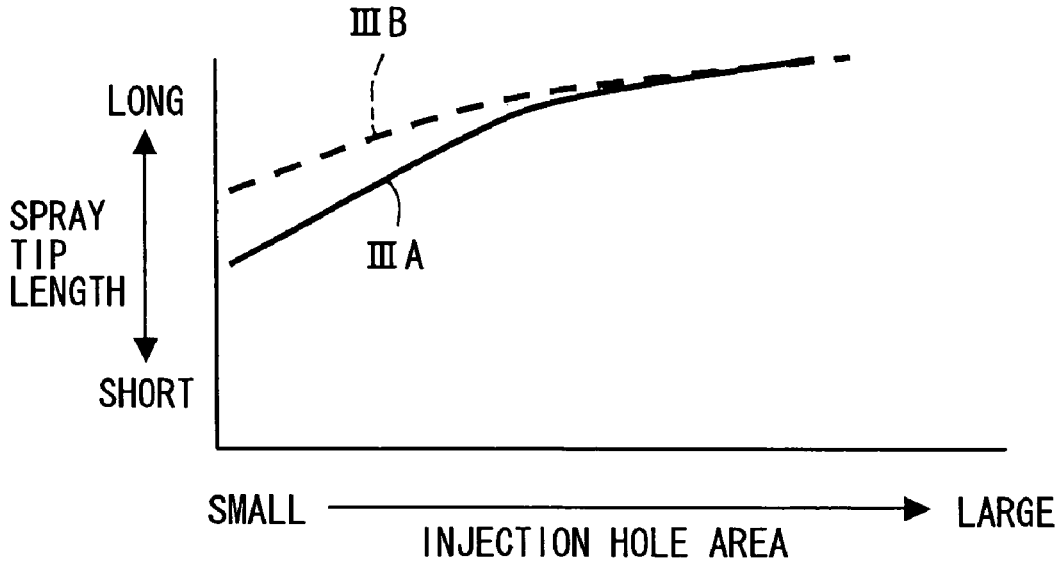
FIG. 3A is a graph showing a relationship between an injection hole area and a spray tip length.
Figure 3B:
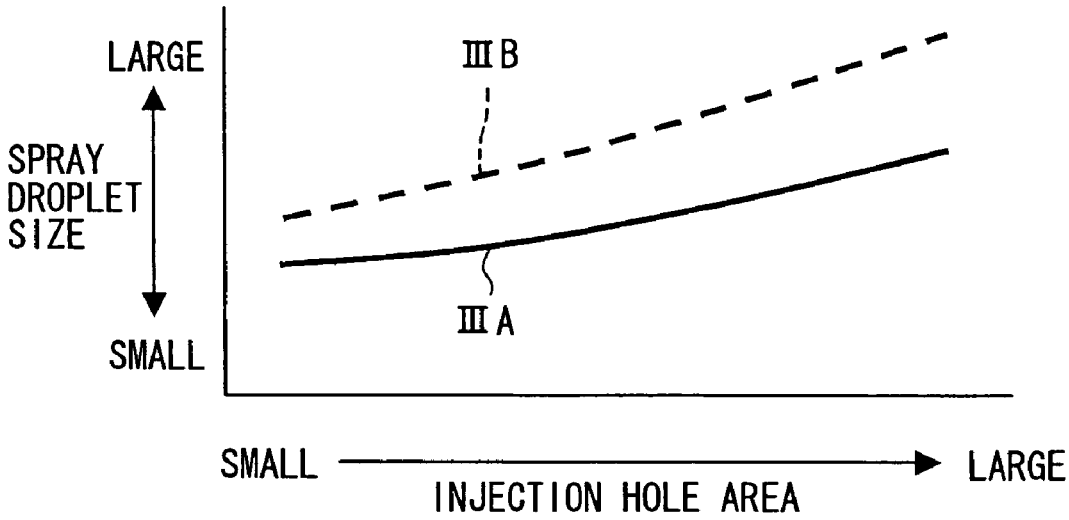
FIG. 3B is a graph showing a relationship between the injection hole area and a spray droplet size.

FIG. 3A shows a relationship between an injection hole area and a fuel spray tip length. FIG. 3B shows a relationship between the injection hole area and a spray droplet size, i.e., dimensions of a drop of the fuel jet. IIIA represents a single injection outlet, and IIIB represents a multi-injection outlet. Here, injection axes of the injection holes 7 in the multi-injection outlet are in parallel each other. In FIGS. 3A and 3B, flow amount of the single injection outlet IIIA is equal to that of the multi-injection outlet IIIB.

In the single injection outlet, as shown in FIG. 3B, when the injection hole diameter D, which is an inner diameter of the injection hole 7 in FIG. 2B, becomes smaller, the spray droplet size becomes smaller. Thus, the fuel jet is much atomized as the area D becomes small.

However, when the injection hole diameter D becomes smaller, the spray tip length becomes shorter, i.e., smaller, as shown in FIG. 3A.

In the multi-injection outlet shown as IIIB in FIG. 3B, as each injection hole diameter D of the injection holes 7 becomes smaller, the fuel is atomized, i.e., the spray droplet size of the fuel jet injected from each injection hole 7 becomes smaller. Even when the injection hole diameter D is small, the spray tip length of the fuel jet injected from the multi-injection outlet is sufficiently large, i.e., the spray penetration of the fuel jet is sufficiently obtained by interacting the fuel jets jetted from the injection holes 7.

To optimize both of the atomization and the spray penetration of the fuel jet, the multi-injection outlet has the following characteristics.

As shown in FIGS. 1A and 1B, an injection hole area of each injection hole 7 is defined as D, a distance between an outlet of the injection hole 7 and a cross point of center axes of the injection holes 7 is defined as a cross point distance X, and a cross point angle is defined as θ. The center axes of the injection holes 7 intersect at the cross point with the cross point angle θ and the cross point distance X. In this example embodiment, the injection hole diameter D is in a range between 0.05 mm and 0.1 mm. The cross point distance X is in a range between 10 D and 100 D. The cross point angle θ is in a range between 1° and 10°.

When the injection hole diameter D is equal to or smaller than 0.1 mm, the spray droplet size becomes sufficiently small so that the sufficient atomization of the fuel jet is obtained.

Further, when the injection hole diameter D is equal to or larger than 0.05 mm, the injection hole 7 is prevented from clogging with a foreign particle in the fuel. Thus, stable and reliable fuel injection is secured.

Thus, when the injection hole diameter D is in a range between 0.05 mm and 0.1 mm, both of the sufficient atomization and the stable and reliable fuel injection are obtained.

The fuel jet injected from the injection hole 7 is diffused with mixing with atmospheric gas in the chamber 13. Accordingly, the spray penetration is reduced as the fuel jet separates from the outlet of the injection hole 7.

To maintain the spray penetration, fuel jets injected from the injection holes 7 are intersected, as shown in FIG. 1A even when the fuel jet is sufficiently atomized. To obtain both of the sufficient spray penetration and the sufficient atomization, the cross point distance X and the cross point angle θ are optimized.

Figure 4A:
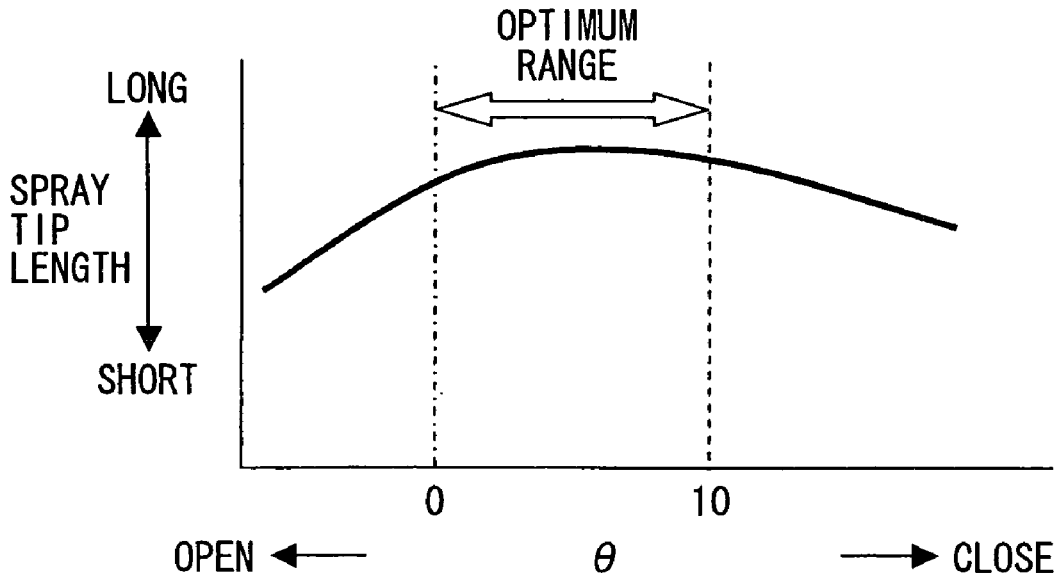
FIG. 4A is a graph showing a relationship between a cross point angle and the spray tip length.
Figure 4B:
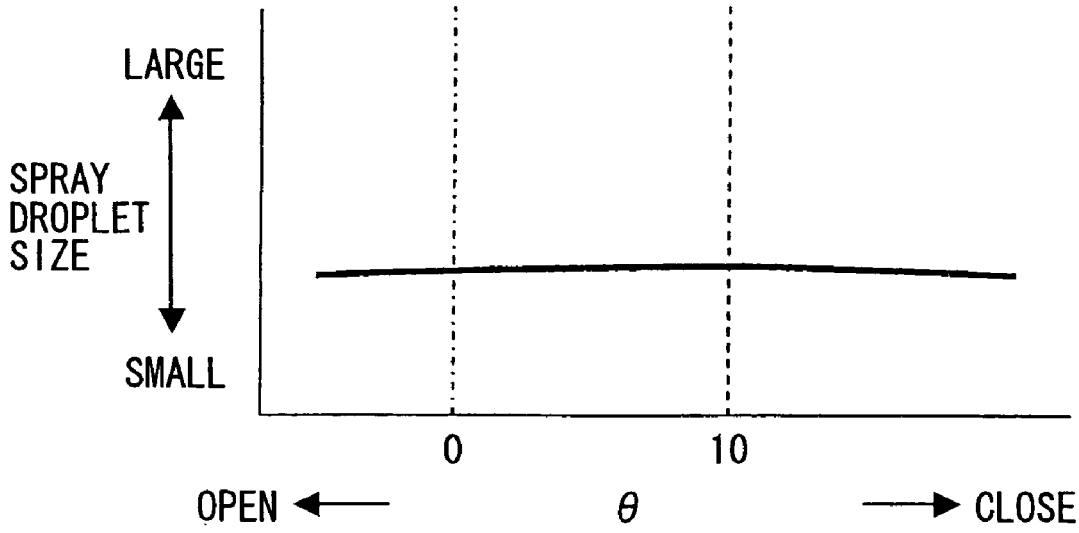
FIG. 4B is a graph showing a relationship between the cross point angle and the spray droplet size.

When the cross point distance X is smaller than 10 D, the cross point angle θ of the center axes of the injection holes 7 becomes larger. Thus, the fuel jets from the injection holes 7 strike, i.e., intersect each other with a large angle, i.e., a large cross point angle θ. Thus, the spray penetration along with an injection direction is much reduced. Thus, the spray tip length becomes short. Specifically, when the cross point distance X is smaller than 10 D, the cross point angle θ is larger than 10°. In this case, as shown in FIG. 4A, the spray penetration becomes small, and therefore, the spray tip length is also small. In FIGS. 4A and 4B, "open" means the center axes of the injection holes 7 expand, and "close" means the center axes of the injection holes 7 intersect, i.e., the cross point distance X becomes smaller. In FIGS. 4A and 4B, the injection hole distance L is constant, and the injection hole diameter D is constant.

Figure 5A:
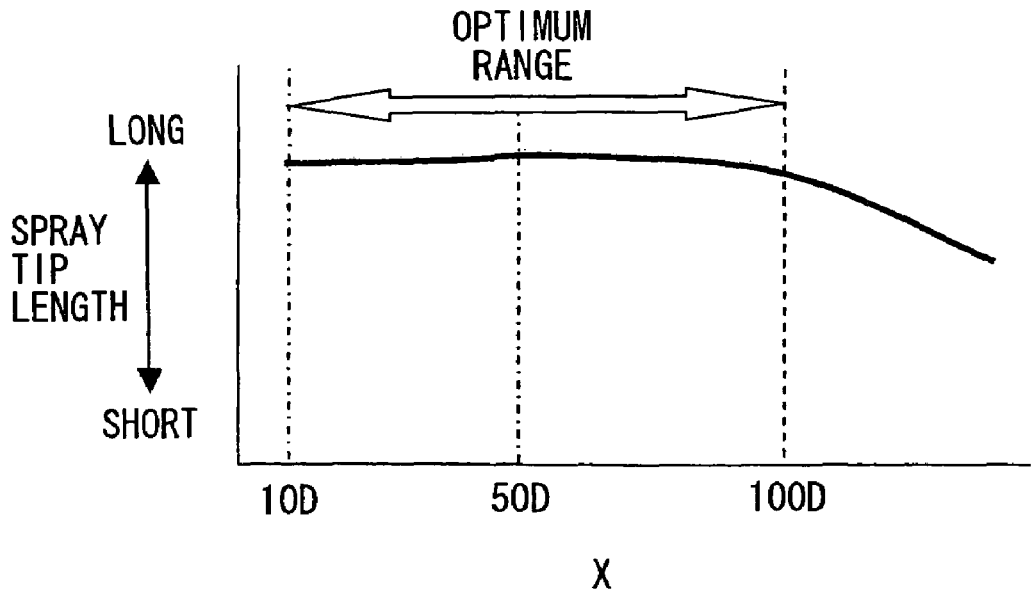
FIG. 5A is a graph showing a relationship between a cross point distance and the spray tip length.
Figure 5B:
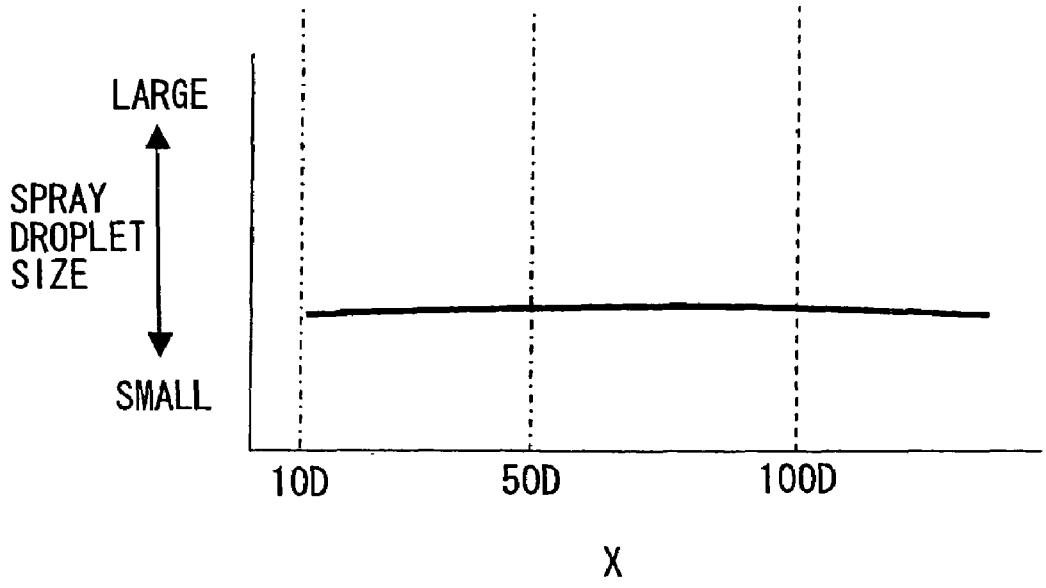
FIG. 5B is a graph showing a relationship between the cross point distance and the spray droplet size.

When the cross point distance X is larger than 100 D, the cross point angle θ approaches zero. Here, when the cross point angle θ is zero, the center axes of the injection holes 7 become parallel each other. Thus, the interaction between the fuel jets injected from the injection holes 7 becomes small, so that the spray tip length of the fuel jet becomes short. Specifically, when the cross point distance X is larger than 100 D, the cross point angle θ of the center axes of the injection holes 7 is smaller than 1°. Accordingly, the fuel jets from holes 7 is atomized and miniaturized, and then, the fuel jets are mixed with the air. Thus, as shown in FIG. 5A, the spray penetration is reduced, and the spray tip length becomes short.

Thus, to maintain the spray penetration by interacting the fuel jets each other, each jet which is miniaturized in accordance with miniaturization of the injection hole diameter D, the cross point distance X is set to be in a range between 10 D and 100 D, and the cross point angle θ is to be in a range between 1° and 10°. In this range, i.e., the optimum range, the spray tip length is large, i.e., sufficiently long. Accordingly, both of the atomization and the spray penetration of the fuel jet are achieved. Thus, the combustion of the air with the fuel jet is completed sufficiently in the engine.

Specifically, the spray tip length of the atomized fuel jet is controlled so that the spray tip length in accordance with an inner wall distance S from the injection hole 7 and an inner wall 21 of the chamber 13 is appropriately controlled. Thus, the air with the fuel jet disposed in the chamber 13 between the injection hole 7 and the inner wall 21 of the chamber 13 is completely utilized, so that the combustion of the fuel jets, which are sprayed from the injection holes 7, is completed before the fuel jets reach the inner wall 21 of the chamber 13.

In this example embodiment, the fuel pressure of the fuel introduced into the injection nozzle is equal to or larger than 100 MPa. Specifically, a fuel pressure maintaining means such as a common-rail supplies the fuel in the fuel introduction passage of the nozzle. The fuel pressure of the fuel introduced in the passage 5 is equal to or larger than 100 MPa.

Figure 6:
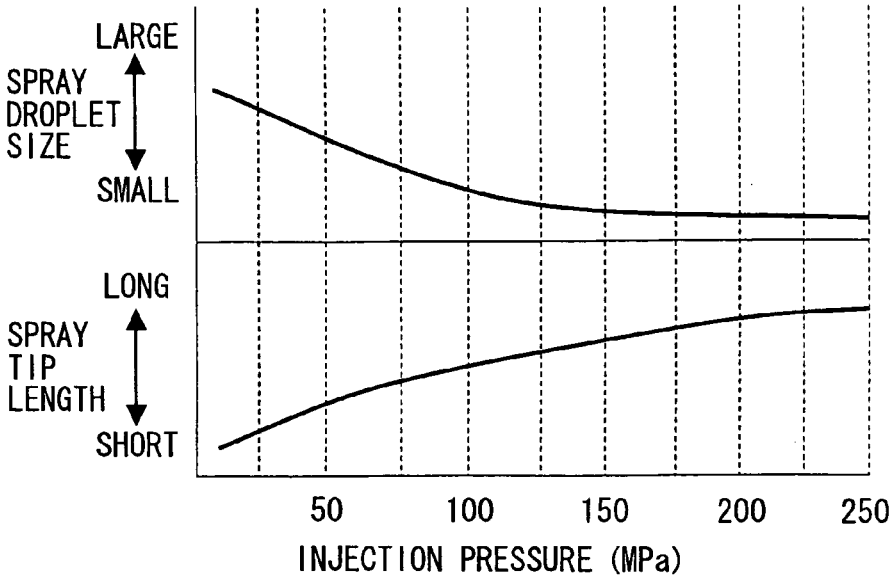
FIG. 6 is a graph showing a relationship between an injection pressure and the spray droplet size or between the injection pressure and the spray tip length.

In this case, as shown in FIG. 6, the spray droplet size is small, and the spray tip length is long because injection energy of the fuel jetted from the injection holes 7 is increased.

In this example embodiment, the fuel jet jetted from the nozzle is sprayed into the chamber 13, as shown in FIG. 7. The combustion chamber 13 is a space surrounded with a cylinder head and a piston of the engine. The fuel jetted from the nozzle is sprayed along with an injection axis of the injection outlet 6. Here, the injection axis is a center line of the fuel jet, which is connected between a center α between the injection holes 7 and the cross point of the center axes of the injection holes 7. As shown in FIGS. 1A and 1B, the center α is disposed between two adjacent injection holes 7. A distance between two injection holes 7 is defined as L, and the inner wall distance S is defined as a distance from the outlet of each injection hole 7 to the inner wall 21 of the chamber 13.

The inner wall distance S is limited if the combustion is completed sufficiently in the engine. This is because the fuel jet is diffused and mixed with atmospheric gas when the spray tip length exceeds a predetermined distance, i.e., a limitation of the spray tip length. Thus, a limitation of the inner wall distance S is determined by optimum combustion defined by the limitation of the spray tip length.

Specifically, when the injection hole diameter D is equal to or smaller than 0.1 mm, the cross point distance X is in a range between 10 D and 100 D, and the cross point angle θ is in a range between 1° and 10°, the upper limitation of the inner wall distance S is 450 D. In this case, the optimum combustion is obtained.

On the other hand, when the spray tip length is much short, the air in the chamber 13 is not sufficiently used for the combustion. Therefore, the inner wall distance S has a lower limitation.

Specifically, when the injection hole diameter D is equal to or smaller than 0.1 mm, the cross point distance X is in a range between 10 D and 100 D, and the cross point angle θ is in a range between 1° and 10°, the lower limitation of the inner wall distance S is 350 D. In this case, the optimum combustion is obtained.

Thus, when the inner wall distance S is in a range between 350 D and 450 D, the optimum combustion is obtained.

Figure 8:
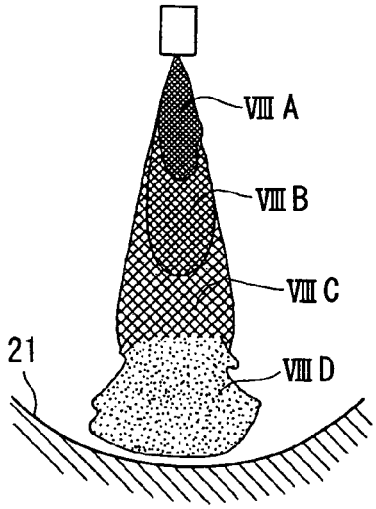
FIG. 8 is a schematic view showing optimum injection from the nozzle.

The optimum range of the inner wall distance S depends on a design of the engine and an engine displacement. When the engine has a small engine displacement, the inner wall distance S is short. When the engine has a large engine displacement, the inner wall distance S is long. In both cases, it is required for the engine to form a preliminary mixture region VIIIC at an optimum position in the chamber 13, as shown in FIG. 8. In FIG. 8, the fuel jetted from the nozzle is initially expands in the initial injection region VIIIA. Then, the fuel jet is atomized and evaporated so that the fuel jet expands in the atomization and evaporation region VIIIB. Then, the fuel jet expands in the preliminary mixture region VIIIC. Finally, the fuel jet burns in the combustion region VIIID. Thus, the fuel jet is completely combusted just before the fuel jet reaches the inner wall 21 of the chamber 13.

Figure 9A:
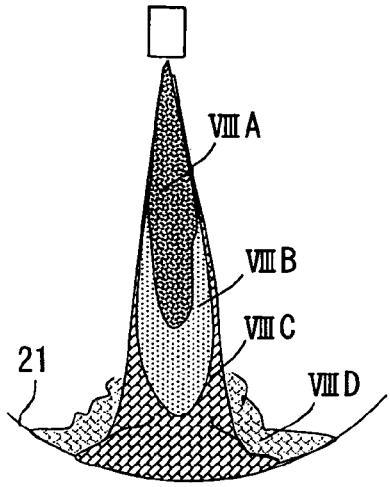
FIG. 9A PRIOR ART
FIGS. 9A and 9B are schematic views showing inadequate injection from the nozzle.

When the spray tip length of the fuel jet is much longer than the inner wall distance S, as shown in FIG. 9A, the fuel jet reaches and strikes the inner wall 21 of the chamber 13 before the combustion of the fuel jet is completed. Thus, fuel concentration becomes inhomogeneous, so that smoke in an exhaust gas discharged from the diesel engine generates.

Figure 9B:
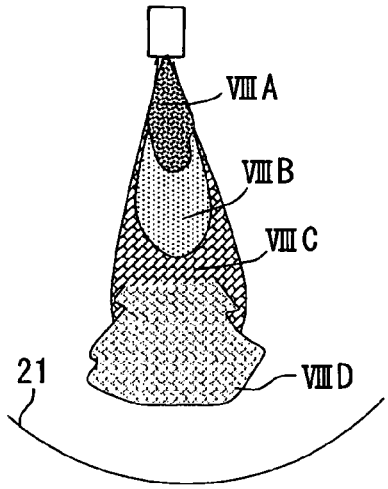
FIG. 9B PRIOR ART

When the spray tip length of the fuel jet is much shorter than the inner wall distance S, as shown in FIG. 9B, the fuel jet is not mixed sufficiently with the air in the chamber 13. Thus, the smoke generates in the exhaust gas.

Thus, the optimum spray penetration, i.e., the optimum spray tip length is determined on the basis of construction of the engine, i.e., on the basis of the inner wall distance S.

Figure 10:
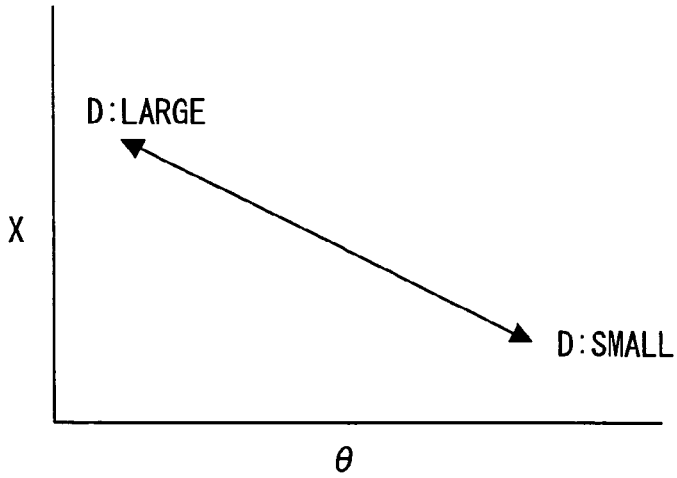
FIG. 10 is a graph showing a relationship between the cross point angle and the cross point distance.

As shown in FIG. 10, when the inner wall distance S is in a range between 350 D and 450 D, and the inner wall distance S is comparatively small, i.e., the engine has a small displacement, a relationship between the cross point distance and the cross point angle θ is defined in a direction to "D:SMALL." In this case, the injection hole diameter D is set to be small in a range between 0.05 mm and 0.1 mm. Further, the cross point distance X is set to be short in a range between 10 D and 100 D. In this case, by setting the injection hole diameter D to be small, the fuel jet is atomized in an initial stage after the fuel is jetted. Thus, the spray tip length becomes short. However, since the cross point distance X is set to be short, and the cross point angle θ is set to be large, the sufficient spray tip length of the fuel jet is obtained. Thus, as shown in FIG. 8, the fuel jet is atomized before the fuel jet reaches the inner wall 21 of the chamber 13, so that the fuel jet and the air are mixed. Thus, homogeneous mixed air with the fuel jet is formed. Accordingly, the optimum combustion in the chamber 13 is obtained.

When the inner wall distance S is in a range between 350 D and 450 D, and the inner wall distance S is comparatively large, i.e., the engine has a large displacement, a relationship between the cross point distance and the cross point angle θ is defined in a direction to "D:LARGE." In this case, the injection hole diameter D is set to be large in a range between 0.05 mm and 0.1 mm. Further, the cross point distance X is set to be long in a range between 10 D and 100 D. In this case, by setting the injection hole diameter D largely, the spray tip length of the fuel jet increases, as shown in FIG. 3A. Further, since the cross point distance X is set to be long, loss of the spray penetration caused by striking of the fuel jets is reduced; and therefore, the spray tip length of the fuel jet is increased.

Thus, as shown in FIG. 8, the preliminary mixture region VIIIC is formed at an appropriate position so that the optimum combustion is obtained.

Figure 12A:
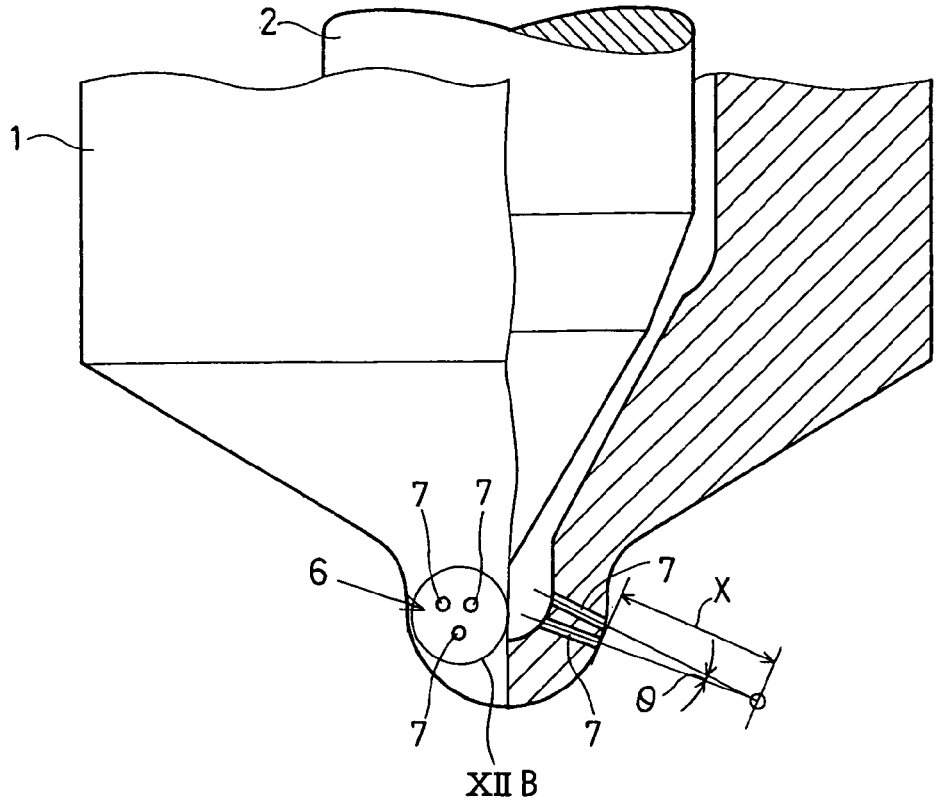
FIG. 12A is a schematic view showing a part of a fuel injection nozzle according to a second example embodiment.
Figure 12B:
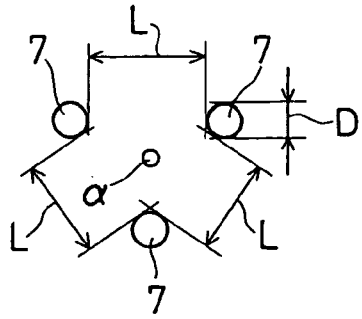
FIG. 12B is a partially enlarged plan view showing a part XIIB in FIG. 12A.
Figure 12C:
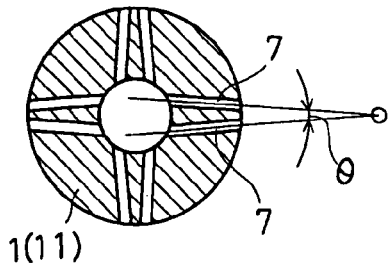
FIG. 12C is a schematic view explaining multiple injection holes in the nozzle.

A fuel injection nozzle according to another example embodiment is shown in FIGS. 12A to 12C. In this nozzle, the injection outlet 6 includes three injection holes 7. The number of the injection holes, i.e., three in this case, is determined on the basis of the injection hole diameter D and required injection flow amount of the engine. Each injection hole distance L between two injection holes 7 is constant so that the interaction among the injection jets from the injection holes 7 is homogeneous. Each center axis of the injection holes 7 crosses at one point so that each cross point distance X is constant. Specifically, each center axis of the injection holes 7 crosses on an injection axis, which passes through the center α among the injection holes 7. Here, in this case, the center α provides a weighted center among the injection holes 7.

In this nozzle, both of the atomization and the spray penetration of the fuel jet are optimized. Further, since the number of the injection holes 7 composing the injection outlet 6 increases, the injection hole diameter D can be decreased. Accordingly, the atomization of the fuel jet is much improved.

Furthermore, the interaction among the fuel jets from the injection holes 7 becomes strong. Accordingly, the spray tip length of the fuel jet becomes longer.

Thus, by adjusting the number of the injection holes 7, the atomization of the fuel and the spray penetration of the fuel jet are controlled appropriately.

Figure 13A:
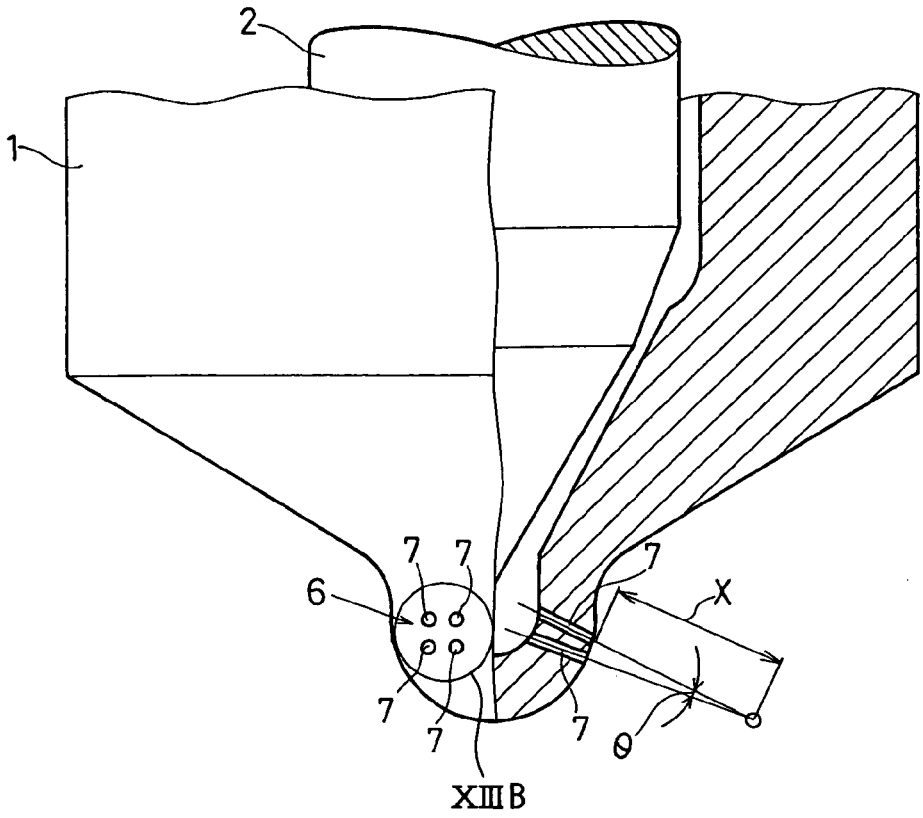
FIG. 13A is a schematic view showing a part of a fuel injection nozzle according to a third example embodiment.
Figure 13B:
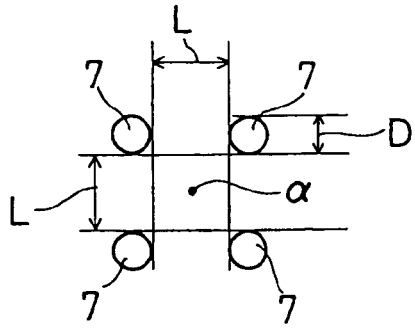
FIG. 13B is a partially enlarged plan view showing a part XIIIB in FIG. 13A.
Figure 13C:
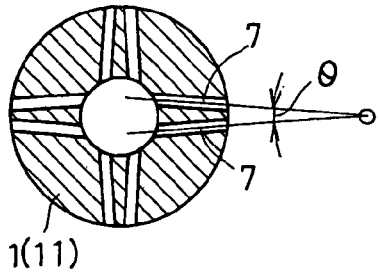
FIG. 13C is a schematic view explaining multiple injection holes in the nozzle.

A fuel injection nozzle according to further another example embodiment is shown in FIGS. 13A to 13C.

In this nozzle, the injection outlet 6 includes four injection holes 7. The number of the injection holes, i.e., four in this case, is determined on the basis of the injection hole diameter D and required injection flow amount of the engine. Each injection hole distance L between two injection holes 7 is constant so that the interaction among the injection jets from the injection holes 7 is homogeneous. Each center axis of the injection holes 7 crosses at one point so that each cross point distance X is constant. Specifically, each center axis of the injection holes 7 crosses on an injection axis, which passes through the center α among the injection holes 7. Here, in this case, the center α provides a weighted center among the injection holes 7.

Thus, even when the number of the injection holes 7 is increased, the atomization of the fuel and the spray penetration of the fuel jet are controlled appropriately.

Although the injection hole diameter D is in a range between 0.05 mm and 0.1 mm, the injection hole diameter D is preferably set to be small in order to atomize the fuel smaller. Therefore, in some case, the injection hole diameter D may be smaller than 0.05 mm. Further, in some case, the injection hole diameter D may be larger than 0.1 mm. For example, the injection hole diameter D may be 0.11 mm, 0.12 mm or 0.13 mm.

The above disclosure has the following aspects.

According to a first aspect of the present disclosure, a fuel injection nozzle includes: an injection outlet having a plurality of injection holes. Each injection hole has an injection hole diameter defined as D. Each injection hole has an outlet port and a center axis. The center axes of the injection holes cross at a cross point with a cross angle. A cross point distance between each outlet port of the injection holes and the cross point is defined as X. The cross angle of the center axes of the injection holes is defined as θ. The cross point distance X is in a range between 10 D and 100 D, and the cross angle θ is in a range between 1° and 10°.

In the above nozzle, sufficient atomization of the fuel and sufficient spray penetration of the fuel jet are obtained. Thus, the spray tip length of the atomized fuel jet can be controlled so that the spray tip length is determined in accordance with the inner wall distance between the injection outlet and the inner wall of the combustion chamber. Thus, the injection outlet is capable of injecting the fuel toward the inner wall of the combustion chamber in such a manner that air in the combustion chamber disposed between the injection outlet and the inner wall of the combustion chamber is completely utilized for combustion by controlling spray penetration of a fuel jet injected from the injection outlet, and that the combustion of the fuel injected from the injection outlet is substantially completed before the fuel jet reaches the inner wall of the combustion chamber.

Alternatively, the nozzle may further include a plurality of injection outlets. Each injection outlet includes a plurality of injection holes.

Alternatively, when the injection hole diameter D is comparatively small in a range between 0.05 mm and 0.1 mm, the cross point distance X may be set to be shorter in a range between 10 D and 100 D, and the cross angle θ may be set to be smaller in a range between 1° and 10°. When the injection hole diameter D is comparatively large in a range between 0.05 mm and 0.1 mm, the cross point distance X may be set to be longer in a range between 10 D and 100 D, and the cross angle θ may be set to be larger in a range between 1° and 10°.

In the above case, when the injection hole diameter D is comparatively small, the spray penetration is rapidly reduced since the fuel is atomized just after the fuel is injected. Thus, the cross point distance X is set to be shorter, and the cross angle θ is set to be smaller, so that the interaction between the fuel jets from the injection holes is increased. Accordingly, the spray tip length becomes long enough so that the preliminary mixture region is formed appropriately.

On the other hand, when the injection hole diameter D is comparatively large, the atomization of the fuel jet is comparatively late. Thus, the cross point distance X is set to be longer, and the cross angle θ is set to be larger, so that the interaction between the fuel jets from the injection holes is decreased. Accordingly, a region having a high fuel concentration is formed, and the spray tip length becomes long enough so that the preliminary mixture region is formed appropriately.

According to a second aspect of the present disclosure, a fuel injection nozzle includes an injection outlet having a plurality of injection holes. Each injection hole has an injection hole diameter defined as D. Each injection hole has an outlet port and a center axis. The center axes of the injection holes cross at a cross point with a cross angle. A cross point distance between each outlet port of the injection holes and the cross point is defined as X. The cross angle of the center axes of the injection holes is defined as θ. The cross point distance X is in a range between 10 D and 100 D. The cross angle θ is in a range between 1° and 10°. The injection hole diameter D is in a range between 0.05 mm and 0.1 mm. The injection outlet is capable of injecting a fuel having a fuel pressure equal to or larger than 100 MPa. The injection outlet is capable of injecting the fuel into a combustion chamber along with an injection direction. The combustion chamber has an inner wall. An inner wall distance between each outlet port of the injection holes and the inner wall of the combustion chamber in the injection direction of the injection outlet is defined as S. The inner wall distance S is in a range between 350 D and 450 D. The injection outlet is capable of injecting the fuel toward the inner wall of the combustion chamber in such a manner that air in the combustion chamber disposed between the injection outlet and the inner wall of the combustion chamber is completely utilized for combustion by controlling spray penetration of a fuel jet injected from the injection outlet, and that the combustion of the fuel injected from the injection outlet is substantially completed before the fuel jet reaches the inner wall of the combustion chamber.

In the above nozzle, sufficient atomization of the fuel and sufficient spray penetration of the fuel jet are obtained. Thus, the spray tip length of the atomized fuel jet can be controlled so that the spray tip length is determined in accordance with the inner wall distance between the injection outlet and the inner wall of the combustion chamber.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. A fuel injection nozzle comprising:

an injection outlet having a plurality of injection holes, wherein each injection hole has an injection hole diameter defined as D, each injection hole has an outlet port and a center axis, the center axes of the injection holes cross at a cross point with a cross angle, a cross point distance between each outlet port of the injection holes and the cross point is defined as X, the cross angle of the center axes of the injection holes is defined as θ, the cross point distance X is in a range between 10D and 100D, and the cross angle θ is in a range between 1° and 10°.

2. The nozzle according to claim 1, further comprising:

a plurality of injection outlets, wherein each injection outlet includes a plurality of injection holes.

3. The nozzle according to claim 1, wherein the injection hole diameter D is in a range between 0.05 mm and 0.1 mm.

4. The nozzle according to claim 1, wherein the injection outlet is capable of injecting a fuel having a fuel pressure equal to or larger than 100 MPa.

5. The nozzle according to claim 1, wherein when the injection hole diameter D is comparatively small in a range between 0.05 mm and 0.1 mm, the cross point distance X is set to be shorter in a range between 10 D and 100 D, and the cross angle θ is set to be smaller in a range between 1° and 10°, and when the injection hole diameter D is comparatively large in a range between 0.05 mm and 0.1 mm, the cross point distance X is set to be longer in a range between 10 D and 100 D, and the cross angle θ is set to be larger in a range between 1° and 10°.

6. The nozzle according to claim 1, wherein the injection outlet is capable of injecting a fuel into a combustion chamber along with an injection direction, the combustion chamber has an inner wall, an inner wall distance between each outlet port of the injection holes and the inner wall of the combustion chamber in the injection direction of the injection outlet is defined as S, and the inner wall distance S is in a range between 350 D and 450 D.

7. A fuel injection nozzle comprising:

an injection outlet having a plurality of injection holes, wherein each injection hole has an injection hole diameter defined as D, each injection hole has an outlet port and a center axis, the center axes of the injection holes cross at a cross point with a cross angle, a cross point distance between each outlet port of the injection holes and the cross point is defined as X, the cross angle of the center axes of the injection holes is defined as θ, the cross point distance X is in a range between 10 D and 100 D, the cross angle θ is in a range between 1° and 10°, the injection hole diameter D is in a range between 0.05 mm and 0.1 mm, the injection outlet is capable of injecting a fuel having a fuel pressure equal to or larger than 100 MPa, the injection outlet is capable of injecting the fuel into a combustion chamber along with an injection direction, the combustion chamber has an inner wall, an inner wall distance between each outlet port of the injection holes and the inner wall of the combustion chamber in the injection direction of the injection outlet is defined as S, the inner wall distance S is in a range between 350 D and 450 D, and the injection outlet is capable of injecting the fuel toward the inner wall of the combustion chamber in such a manner that air in the combustion chamber disposed between the injection outlet and the inner wall of the combustion chamber is completely utilized for combustion by controlling spray penetration of a fuel jet injected from the injection outlet, and that the combustion of the fuel injected from the injection outlet is substantially completed before the fuel jet reaches the inner wall of the combustion chamber.

8. The nozzle according to claim 7, further comprising:

a plurality of injection outlets, wherein each injection outlet includes a plurality of injection holes.

* * * * *